US006152429A

United States Patent [19]

Pettigrew

[11] Patent Number: 6,152,429

[45] Date of Patent: Nov. 28, 2000

[54] FENCE SYSTEM FOR SIMULTANEOUSLY TENSIONING A MULTIPLICITY OF FENCE STRANDS

[76] Inventor: Doug G. Pettigrew, Rte. 9, Box 1176, Converse, Tex. 78109

[21] Appl. No.: 09/067,847

[22] Filed: Apr. 27, 1998

Related U.S. Application Data

[60] Provisional application No. 60/044,992, Apr. 28, 1997.

[51] Int. Cl.[7] ..... B04H 17/82

[52] U.S. Cl. ..... 256/42; 160/328

[58] Field of Search ..... 160/328; 256/35, 256/36, 37, 40, 42, 44, 49, 64, 73; 72/147

[56] References Cited

U.S. PATENT DOCUMENTS

| | | | |
|---|---|---|---|
| 83,038 | 10/1868 | Chaplin | 256/40 X |
| 301,037 | 6/1884 | Worcester | 256/42 |
| 393,504 | 11/1888 | Fuller | 256/42 X |
| 402,439 | 4/1889 | Haas | 160/328 |
| 420,819 | 2/1890 | Merchant | 256/35 X |
| 473,899 | 5/1892 | Berdan | 256/42 |
| 591,732 | 10/1897 | Bohner | 256/35 X |
| 596,987 | 1/1898 | Diller | 256/42 |
| 664,771 | 12/1900 | McCallum | 72/147 |
| 1,998,185 | 4/1935 | Broderick | 256/37 |
| 2,527,877 | 10/1950 | Docken | 256/37 |
| 2,859,944 | 11/1958 | Cisney | 160/328 X |
| 4,465,263 | 8/1984 | Robbins, Jr. | 256/49 X |

*Primary Examiner*—Lynne H. Browne
*Assistant Examiner*—Greg Binda
*Attorney, Agent, or Firm*—Jackson Walker L.L.P.

[57] ABSTRACT

A fence line layout including a first and second termination post, and optional intermediate fence posts. Each termination post is braced to provide tension on fencing material which is attached between them. The fencing material is attached to the first termination post by means of a friction insert process. The fencing material is attached to the second termination posts by means of a tensioning device operated by a single person which can be used to tighten the entire length of the fence line. The fence line system disclosed is less expensive and easier to set up then existing systems.

12 Claims, 6 Drawing Sheets

FENCE SYSTEM FOR SIMULTANEOUSLY TENSIONING A MULTIPLICITY OF FENCE STRANDS

This application claims priority to U.S. Provisional Application Serial No. 60/044,992, filed Apr. 28, 1997.

BACKGROUND OF THE INVENTION

1. Field of The Invention

Applicant's invention relates to a fence construction system; and, more particularly, to a system utilizing a high tensile wire jacketed by a polymer of vinyl coating. Even more particularly, the invention relates to a unique tensioning system for such fence constructions.

2. Background Information

Fences are commonly used to confine livestock, such as farm animals, steers, and thoroughbred race horses. Fences may vary greatly in both structure and materials used in their construction. Fence structures which are commonly available include those made of wire (barbed wire, chain link, etc.), and wood (picket, split rail, etc.).

The materials used to construct a particular fence are often selected on the basis of initial cost, upkeep cost, durability, strength, aesthetic characteristics and animal safety requirements. The most commonly used materials include metal and/or wood. While concrete and stone are readily available, the cost is often prohibitive.

The most commonly used fencing material for livestock has been barbed wire. This is due to the low cost of installation and maintenance that such material presents. However, barbed wire can cause painful and unsightly injury to valuable livestock. Also, such material is difficult for the animal to detect and, all too often, the animal is injured during contact with this unseen barrier. Other materials, such as web wire fencing and cyclone wire fencing suffer from similar limitations. In addition, they tend to be expensive to install and maintain and, over time, can also operate to injure livestock.

Wood fences, on the other hand, while expensive to install and maintain, generally do not operate to injure livestock. Wood fences also offer a pleasing and aesthetic appearance.

In order to solve the difficulties presented by commonly available wire and wood fences, another fencing system using high tensile wire jacketed by polymer or vinyl coating has been developed. This type of fencing is typified by that illustrated in FIG. 8 of U.S. Pat. No. 4,706,942. The text and figures of this patent are incorporated by reference as if set forth fully herein. While the system of jacketed high tensile wire presents a satisfactory solution to the above mentioned problems, it still suffers from an elaborate installation process, which includes a series of complex procedures to tighten the individual wires after securing them to a series of fence posts.

Thus, there is a need for a fencing system which is relatively inexpensive, durable, strong, safe for physical contact with livestock, and relatively easy to install.

SUMMARY OF THE INVENTION

The present invention is a method and apparatus for forming a fence line system. The fence line formed in accordance with the present invention is comprised of a plurality of fence post members that are disposed in an array so as to enclose or divide a given area of land.

The fencing material, preferably a jacketed high tensile wire, is slidably coupled to each of the fence posts. The fence material is generally comprised of at least two wires or fibers having a high tensile strength, ensheathed in a casing material, the casing both enclosing the wires or fibers and retaining them in a fixed vertical separation. The wire or fiber may be of any diameter suitable for the strength required in service. Between the wires or fibers, a plastic sheath assumes the form of a sheet or web so that the cross-section of a strip of fencing material, taken perpendicular to the length of any pair of adjacent wires or fibers, is approximately dumbbell shaped. The web itself may have any thickness, but is preferably in the range of about 0.3 inch to 0.10 inch.

It should be understood that the width of the web may vary based upon the construction goals. Typical widths of webs are 5", 4", and 1". In some cases a single strand of coated wire ¼" in diameter may be used.

The fencing material is slidably mounted on the fence post with the aid of brackets. The fence so constructed has the advantages of high visibility, good strength, and relative low cost installation and upkeep. The fence described herein will neither cut nor gouge the hides of valuable livestock and can be used for the close confinement of such animals.

The fence line layout of the present invention consists of at least two termination assemblies, one at each end of the fence line. The termination assembly further comprises at least one upright fence post, and either a second upright fence post coupled to the first post by a pair of "H" braces with an interconnecting cross-member or, optionally, a second post which is diagonally attached to the first upright post using a diagonal brace.

Disposed between the pair of termination assemblies mentioned above may be a series of intervening fence posts. None of the intervening posts requires the bracing system described above. Such posts are usually set in concrete and remaining support is provided by the fencing material which is slidably attached thereto.

To construct the fence line, one must establish a first termination assembly at a desired location. A second termination assembly is then installed at the other end of the fence line. Finally, a series of intervening fence posts may be set in between the two termination assemblies, depending on the length of the fence line.

Once all of the posts are set in place, the fencing material can then be attached. This may be accomplished at the first termination assembly by simply drilling holes into the post at a height where the wires or fibers will be attached. The fencing material is then cut in such a way as to expose the wires or fibers, and the exposed portions are then threaded into the holes. The web of fencing material is then wrapped completely around the first upright post so as to capture the exposed wires or fibers and provide a friction retaining mechanism.

An alternative first termination assembly may be provided which is identical to the special tensioning bracket attached to the second termination assembly discussed below.

Brackets are used on intervening fence posts to slidably secure the fencing material to each intervening post. A special tensioning bracket is attached to the second termination assembly to capture the far end of the fencing material wires or fibers (exposed in a fashion similar to that used in attaching to the first termination assembly). However, in the case of the tensioning bracket mounted to the second termination assembly, only a pipe wrench and a box wrench/set screw wrench are needed to simultaneously tighten the entire line of fencing material between the two termination assemblies. It is this ease of construction which makes the method of forming the fence described herein, along with the fence line system formed thereby, truly unique. No complicated tensioning assemblies, such as that illustrated in U.S. Pat. No. 4,706,942, are necessary. Installation of long fence lines (e.g., more than 1,000 feet) can be accomplished by a single individual. Also, the fence lines constructed by the method described herein cost less to install (complicated ratcheting tensioners are no longer necessary).

Further, it has been found that the special tensioning bracket may be attached to existing posts of whatever composition to retrofit them to accept the jacketed, high tensile wire fencing materials. The present inventive system may also be utilized to construct short fence runs as well as gates.

BRIEF DESCRIPTION OF THE DRAWINGS

These and other advantages of the invention will become more readily apparent from the following detailed description of the presently preferred exemplary embodiments, taken together with the accompanying drawings, of which.

DETAILED DESCRIPTION OF THE PREFERRED EMBODIMENT

Figure 1:
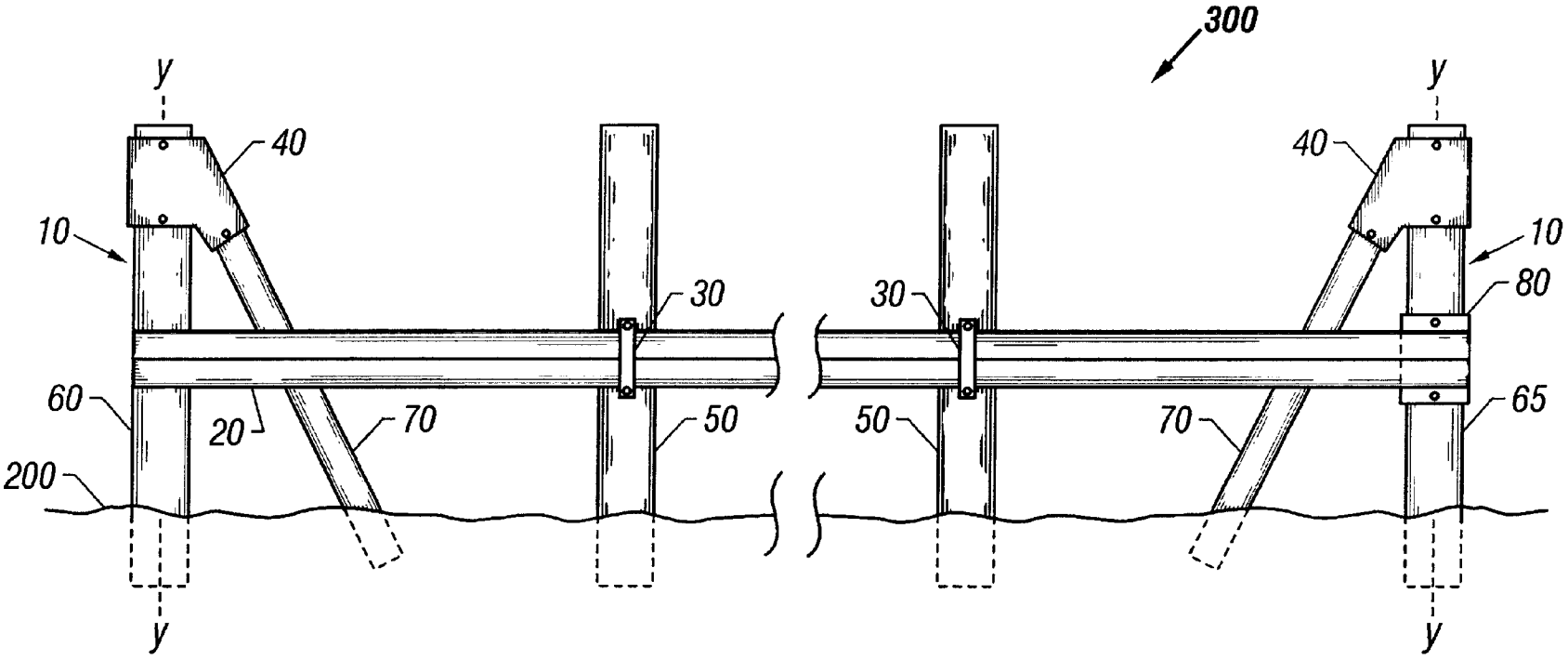
FIG. 1 is a front elevation view of a fence line system of the present invention.

FIG. 1 illustrates a fence line (300) system constructed by implementing the method of the present invention. First termination post (60) is braced against the tension of fencing material (20) by the combination of brace post (70) and angle brace (40). Fencing material (20) is attached to first termination post (60) as will be described subsequently and stretched across intermediate posts (50) as needed, until encountering second termination post (65). Fencing material (20) is pulled tightly across the distance between first termination post (60) and second termination post (65) by means of tensioning member (80). Second termination post (65) is also braced in a fashion similar to that described for first termination post (60), utilizing a brace post (70) and an angle brace (40).

All of the posts used in this invention (50, 60, 70) are inserted into the ground at ground level (200) to a distance approximately equal to the distance each post extends above the ground. Each post (50, 60 and 70) is preferably set into concrete, but may simply be set into the ground, with dirt tamped against it for stability.

While intermediate posts (50) are shown in FIG. 1, they may not be necessary for short runs of fence line (300). That is, for runs of less than approximately thirty feet, only termination assemblies (10) consisting of first or second termination posts (60 or 65) and brace posts (70) in combination with angle braces (40) are required. Also, while only a single line of fencing material (20) is shown in FIG. 1, it may be preferable to have two or three lines of fencing material applied along fence line (300)(e.g., attached at levels of 1, 3, and 5 feet for a 6 foot high fence post). Further, the fencing material illustrated in FIG. 1, 3A and 3B incorporate three spaced apart high tensile wires jacketed by a fencing webbing extending within the space between the wires. In some cases, a single jacketed wire may be used. Once all of the lines of fencing material (20) have been applied to fence line (300), mounting brackets (30) may be attached to intermediate posts (50) (as needed) to slidably secure and support fencing material (20) against intermediate posts (50).

First termination post (60) and second termination post (65) are preferably fabricated from 2⅞ inches O.D. iron pipe, approximately 12 ft. long, for a 6 ft. high fence. Each post has as a longitudinal axis Y. The posts could be of varying sizes to serve as gates. Intermediate posts (50) are likewise preferably constructed from the same material. Brace posts (70) are preferably constructed from 2½ inches O.D. iron pipe, approximately 10 ft. long for a 6 ft. high fence.

Figure 2:
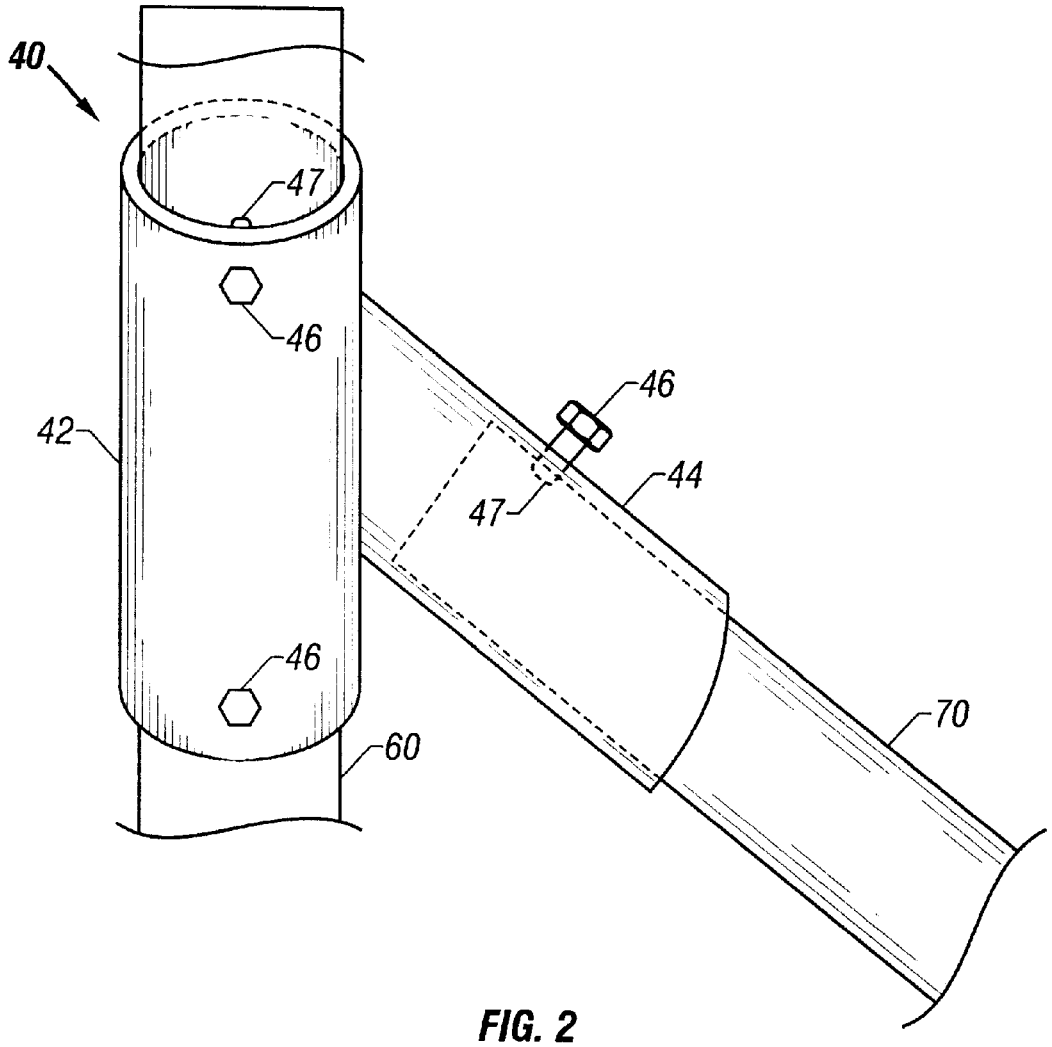
FIG. 2 is a perspective view of an angle brace element of the present invention.

FIG. 2 depicts a perspective view of angle brace (40). Angle brace (40) consists of brace upright (42), which is preferably made from 3 inches I.D. iron pipe approximately 4½ inches long. Brace diagonal (44), preferably constructed from 2½ inches I.D. iron pipe and tapped to accept a bolt or set screw (46), is preferably welded onto the side of brace upright (42) so that its longitudinal axis produces an angle of 45 degrees from a line running parallel to the longitudinal axis of brace upright (42). Brace upright (42) is also tapped to accept bolts (46). As can be seen in FIG. 2, each bolt or screw (46) has a sharpened point (47) to securely fix either first termination post (60) or brace post (70) within the respective encircling element (i.e., brace upright (42) or brace diagonal (44)).

Figure 3A:
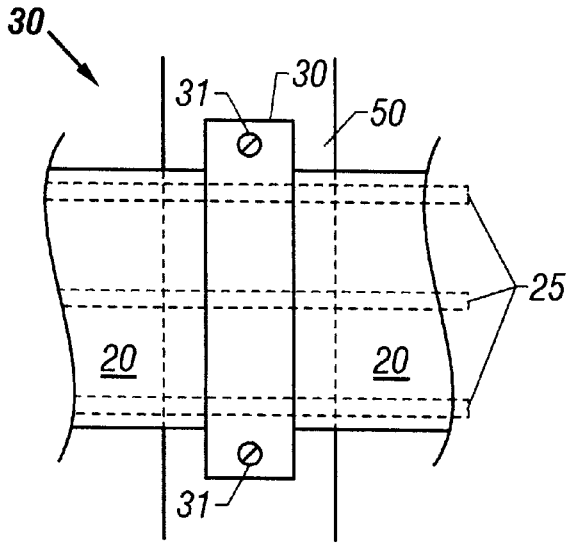
FIG. 3A is a partial front elevation view of a mounting bracket element of the present invention on an intermediate post.
Figure 3B:
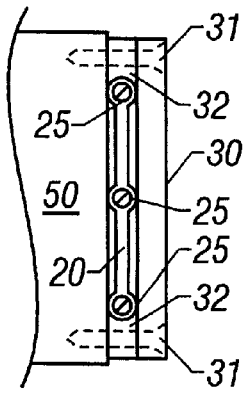
FIG. 3B is a side view of a mounting bracket element of the present invention on an intermediate post.

FIG. 3A shows the front view of a mounting bracket (30), which is used to slidably attach fencing material (20) to intermediate posts (50). Mounting bracket (30) may be attached to intermediate posts by welding, screws, rivets or any other convenient and economical means (31). As can be seen in FIG. 3B, mounting bracket (30) is set off from intermediate post (50) by spacer (32). This provides the proper spacing for fencing material (20) to slidably pass through the void created between mounting bracket (30) and intermediate post (50). Mounting brackets (30) are necessary to the proper construction of fence line (300) for proper containment of larger livestock, which may tend to lean against the fencing material (20) and distort the normal location of fencing material (20) with respect to intermediate post (50).

Figure 4A:
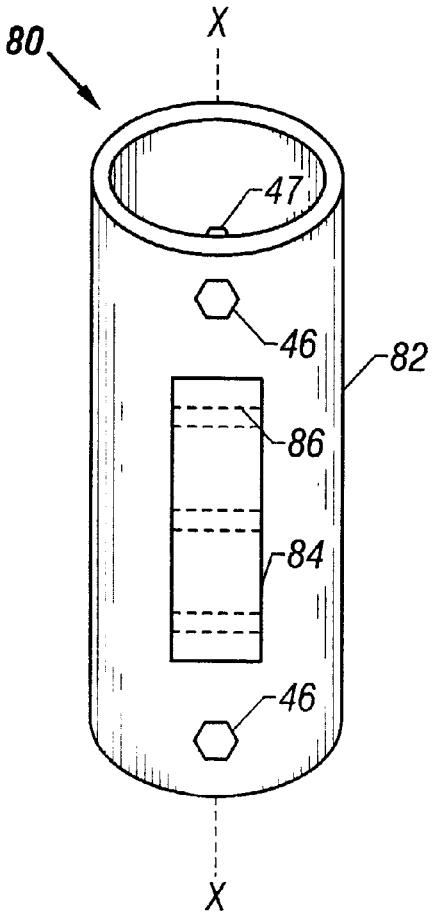
FIG. 4A is a perspective view of a tensioning element of the present invention.

FIG. 4A illustrates a perspective view of tensioning member (80) which may be attached to second termination post (65) and is used to tighten fencing material (20) along its entire length. It should be understood that such a bracket may also be attached to first termination post (60).

Figure 4B:
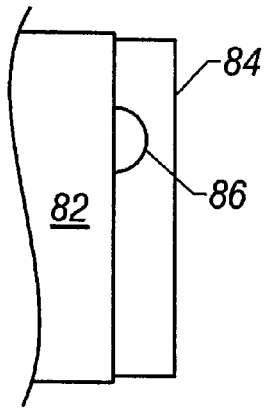
FIG. 4B illustrates a detailed, partial side view of a tensioning element of the present invention.
Figure 5A:
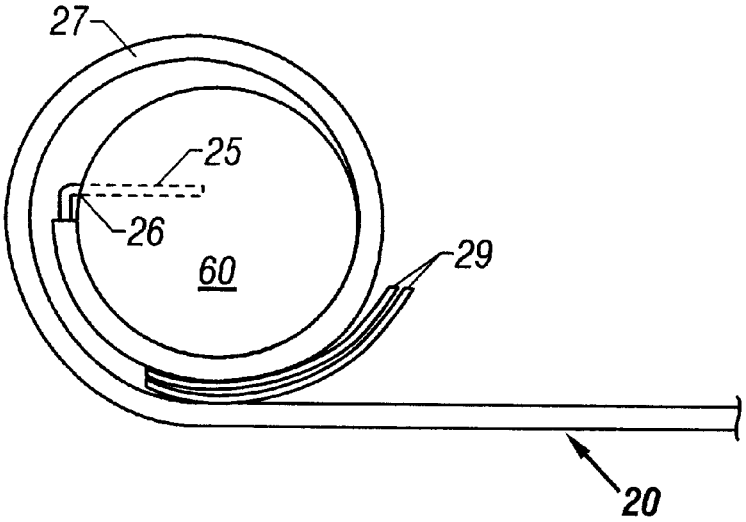
FIG. 5A illustrates a top plan view of a first termination post element of the present invention with shims added.
Figure 5B:
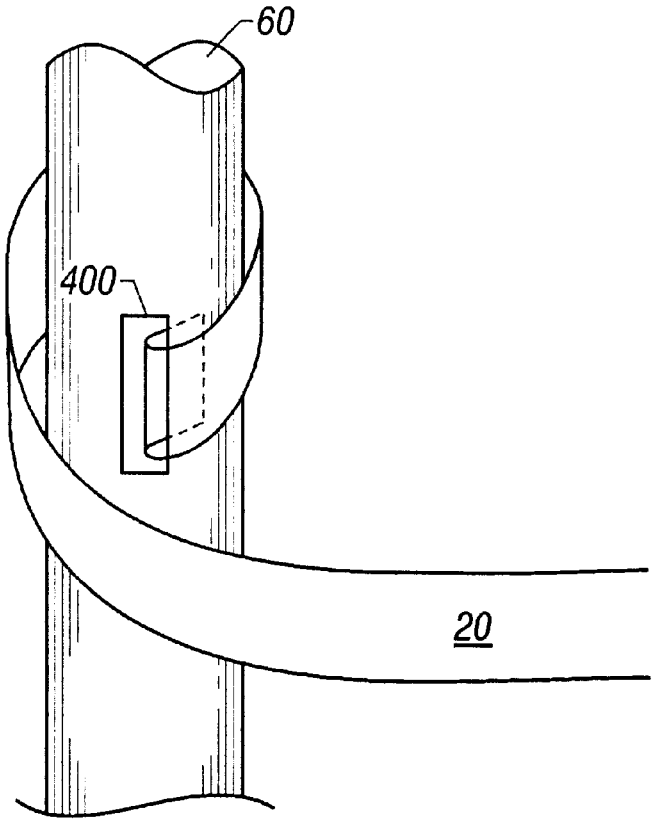
FIG. 5B shows a perspective view of an alternative fabrication method using a first termination post element.

Tensioning member (80) consists of generally cylindrical upright sleeve (82) preferably constructed from 3 inches I.D. iron pipe, and approximately 10 inches long. Sleeve (82) has a rotational axis X. Sleeve (82) is tapped to accept bolts or set screws (46), each having a sharpened point (47) for securely fixing tension member (80) to the termination post (65) after fencing material (20) has been extended between first and second post assemblies (60 and 65). Fencing material connection members(84) are attached to sleeve (82) by welding, screws, rivets or other convenient and economical means. Fencing material connection member (84) is used to accept the insertion of the high tensile wires (25) from fencing material (20) by way of grooves (86). Grooves (86) can be more clearly seen in FIG. 4B. FIG. 5A illustrates a top view of a first termination post (60). Here it can be more clearly seen that fencing material (20) which is composed of a jacketed wire or fiber, but can be of any material which provides a webbed surface, a moderate amount of flexibility, and wires (25) or other elements which can be exposed for bending. In this case, the fencing material (20) has been fabricated so as to remove jacketing or webbing material (27) and expose high-tensile wire (25). Insert hole (26) has been drilled into first termination post (60) so that wire (25) may be inserted into insert hole (26) and then fencing material (20) is wrapped tightly around first termination post (60) so as to cover the insertion point. Fencing material (20) may also be wound several times around the outer circumference of first termination post (60) to provide additional friction holding capability to prevent the extraction of wire (25) from insert hole (26) when fencing material (20) is subjected to the stress of high winds or an animal leaning against fence line (300). In practice, fencing material (20) usually contains two or three high-tensile wires (25). Therefore, two or three corresponding insert holes (26) must be made in first termination post (60) to accommodate all of high-tensile wires (25). As a short-cut-procedure, insert holes (26) may be fabricated as a single slot (400) which is long enough to accept the entire width of jacketing material (27), as shown in FIG. 5B. This allows for very rapid erection of fence line (300), since jacketing material (27) does not have to be removed to expose high-tensile wires (25). Fully jacketed fencing material (20) may be simply inserted into the slot (400) and wrapped tightly around first termination post (60) so as to cover the insertion point. This method of fabrication is actually stronger and can be accomplished much faster than by removing jacketing material (27) to expose high-tensile wires (25) for insertion into holes (26).

In practice, it has been found that the placement or insertion of shim material (29) between layers of fence webbing (27) and in the space between the jacketed wires (25) creates a smooth outer surface to the fencing material when tensioned. This smooth outer surface reduces the stresses on the webbing materials, eliminating or, at least, reducing cracking.

It should further be understood that the connection of the fence material (20) to the first termination post assembly (10) may be achieved through the use of a tensioning member (80) as is discussed below in association with the second termination post assembly.

Figure 6:
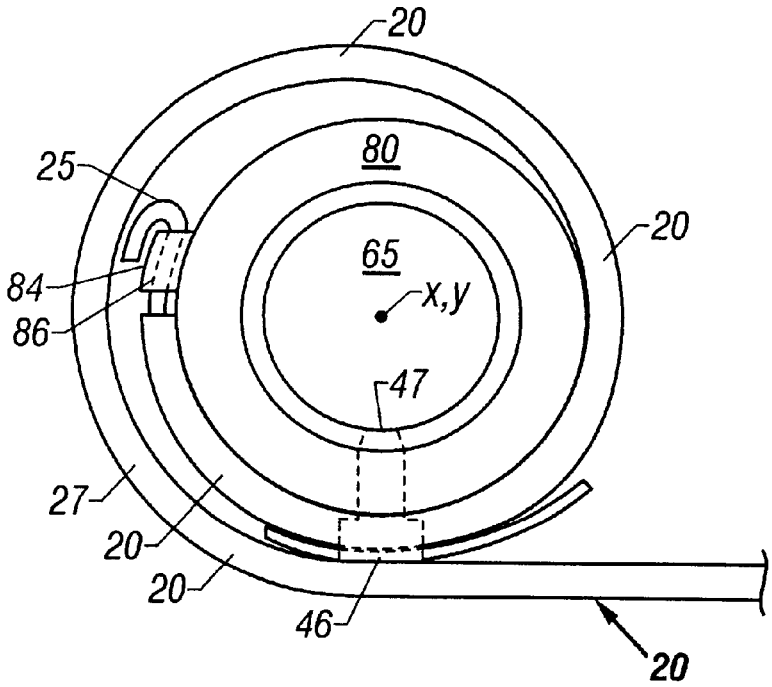
FIG. 6 shows a top view of a second termination post element of the present invention with shims added.

Turning now to FIG. 6, a top view of second termination post (65) can be seen. More particularly, the use of tensioning member (80) is illustrated in detail. Member (80) has been fitted over post (65) with axises (X and Y) aligned. As is the case with first termination post (60), fencing material (20) is fabricated so as to remove jacketing material (27) and expose wire (25). However, in this case, wire (25) is inserted into groove (86) of fencing material connection member (84). A pipe wrench is then applied to the exposed surface of tensioning member (80) so as to enable the person constructing the fence to rotate the outer sleeve (82) about axis X to tighten fencing material (20) along the entire length of fence line (300). This tightening action may be accomplished by turning tensioning bracket (80) in a clockwise or counter-clockwise fashion around the longitudinal axis (Y) of second termination post (65), as is convenient to the fence constructor. Thus, it may be seen in FIG. 6 that the tension member (80) can rotate fully 360° around the post (65). When the correct tension is reached, locking bolt or screw (46) is tightened by the use of an appropriate wrench until sharpened point (47) engages the surface of second termination post (65) locking member (80) in place to hold the proper tension on the fence material. This has the effect of securing the newly tightened fencing material along the entire length of fence line (300). As is apparent from this description, a single fence constructor may simultaneously tighten tensioning member (80) and lock locking bolt (46). No complicated ratchet systems, or other devices, are necessary to tighten the entire length of fencing material (20) along the fence line (300).

Figure 7:
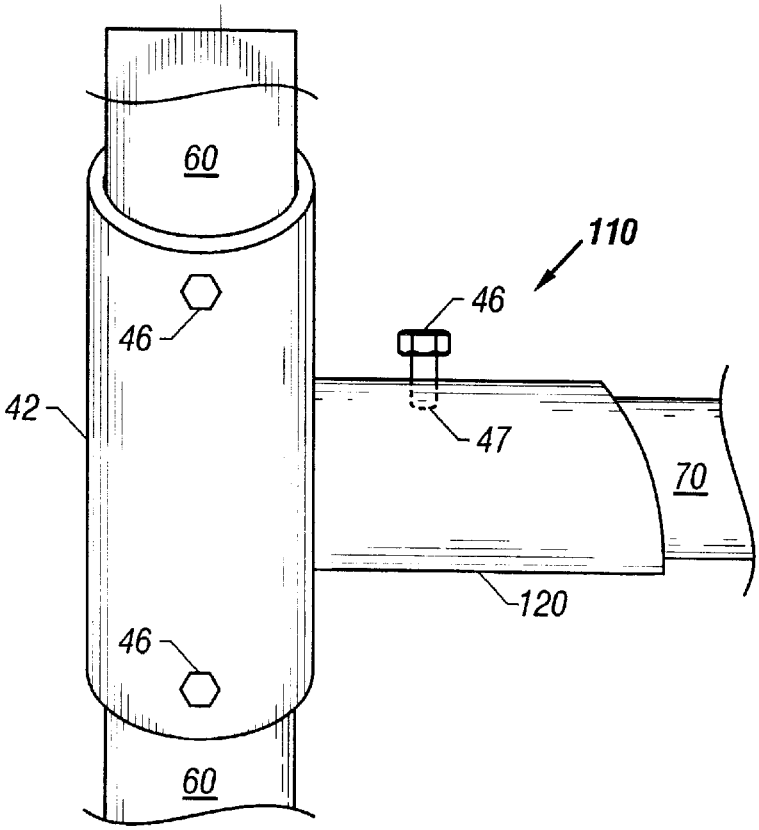
FIG. 7 illustrates a horizontal brace element of the present invention.

FIG. 7 depicts a perspective view of horizontal brace (110) which can be used as an alternative to angle brace (40). Horizontal brace (110) consists of brace upright (42), which is welded directly to brace side piece (120) so as to form a "T" intersection. Brace upright (42) and brace side piece (120) are tapped for bolts (46), which are used to secure the respective encircled posts (i.e., in this case first termination post (60) and brace post (70)). In this case, brace post (70) is not used as a diagonal brace, but is used as a horizontal brace between first termination post (60) and either an intermediate post (50), which also must accommodate a horizontal brace (110), or a second termination post (65) which likewise must accommodate a horizontal brace (110). The use of horizontal brace (110) obviates the need for setting a diagonal brace post (70) into the ground.

Figure 8:
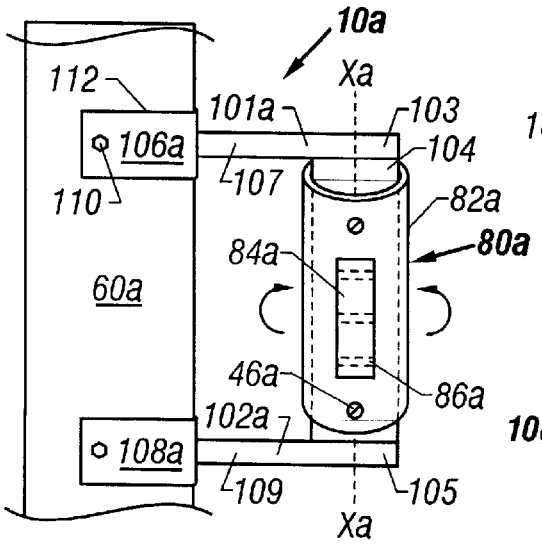
FIG. 8 shows a mounting bracket of the present invention securing a tensioning element to an existing post.
Figure 8A:
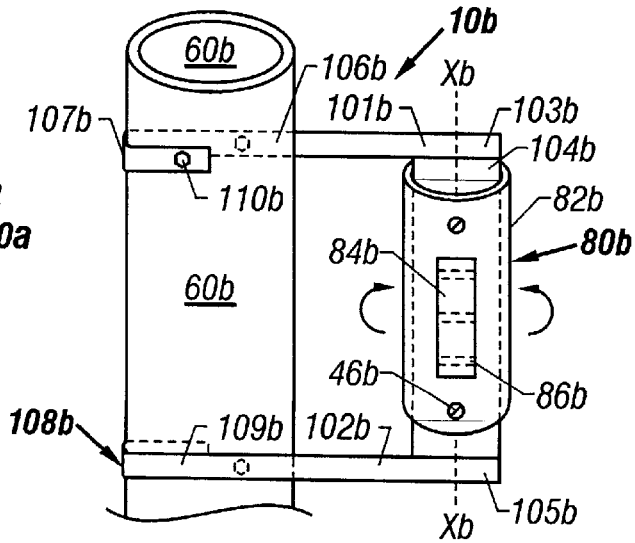
FIG. 8A illustrates an alternative mounting bracket of the present invention securing a tensioning element to a wooden post.

FIGS. 8 and 8A illustrate alternative embodiments of the tensioning member of the present invention. In FIG. 8, a termination post assembly (10*a*) is shown with a generally cylindrical sleeve (82*a*) rotatable about axis (Xa). Two extension arms (upper arm 101*a* and lower arm 102*a*) are attached at first ends (103 and 105) to core member (104) and extends outwardly generally perpendicular to the rotatable sleeve (82*a*). Upper attachment bracket (106*a*) is attached to second end (107) of arm (101*a*). Lower attachment bracket (108*a*) is attached to second end 109 of arm (102*a*).

Brackets 106*a* and 108*a* may be attached to post (60*a*) by any type of fastener (110) or by welding (112) or both. Post (60*a*) may be part of an existing fence line to which the user wishes to attach new fence material or to which the user wishes to improve the tensioning system. The operation of tensioning member (80*a*) is essentially the same as that described for member (80) above. A fencing material connection member (84*a*) is attached to the outer surface of sleeve (82*a*) for receiving and securing wires (25) of the fencing material (20). Locking bolts or screws (46*a*) secure sleeve (82*a*) once the proper tension is obtained.

FIG. 8A illustrates yet another embodiment of a tensioning member (80*b*) to be used with a wooden post (60*b*). It should be understood that the elements of the FIG. 8 embodiment are essentially duplicated with the FIG. 8A embodiment, but two reference numerals bear a "b" designation.

Further, FIG. 8A shows that the upper arm (101*b*) wraps around the back side of the wooden post (60*b*) while the lower arm (102*b*) wraps around the front side of the wooden post (60*b*).

Figure 9:
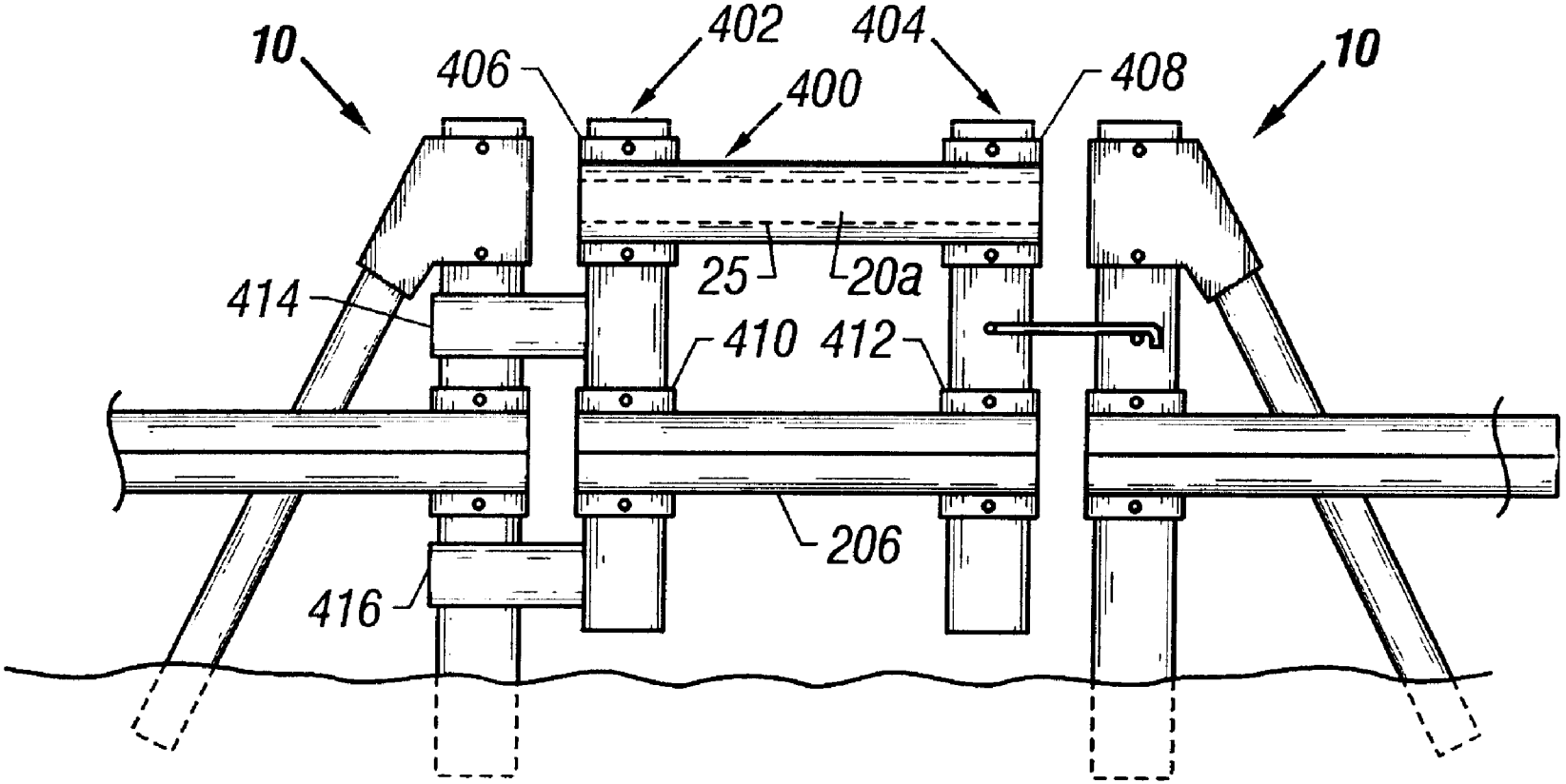
FIG. 9 illustrates a gate of the present invention.

Throughout this discussion, the reference has been made to termination posts. However, these posts may actually be opposite sides of a gate member as shown in FIG. 9. Gate (400) is shown with termination post assemblies (402 and 404). Both assemblies have opposing tension members (406, 408, and 410, 412). Gate (400) is pivotal about hinges (414 and 416). Fencing material (20*a*, 20*b*) extends between posts (402 and 404). Upper material (20*a*) is a two wire type and lower material (20*b*) is a three wire type. Gate (400) may be constructed and assembled as discussed above for a fence line.

The method for constructing a fence system may be seen from an overview of the Figures and includes the steps of: assembling a first termination post (10) having a first fencing material connection member (26). Next the user assembles a second termination post (10) having a fencing material tensioning member (80). The tensioning member (80) further includes: (a) a generally rotatable, cylindrical sleeve member (82) having a rotational axis (X); (b) a second fencing material connection member (84) attached to the sleeve member (82) and extending generally parallel to the rotational axis (X); (c) a locking member (46) attached to the sleeve member (86) to prevent rotation of the sleeve; and (d) a length of fencing material(20) between the first and second termination posts (10). The next steps is connecting one end of the fencing material to the tensioning member (80), and rotating the sleeve (82) to increase tension on said fencing material (20). The locking member (46) is locked to hold tension on fencing material (20). Where the fencing material further includes a multiplicity of spaced apart high tensile wires jacketed by a fence webbing with webbing extending within the space between the wires. The method of constructing further includes the step of: placing shim material between layers of the fence webbing at first and second termination posts.

Although the invention has been described with reference to specific embodiments, this description is not meant to be construed in a limited sense. For example, instead of iron piping, wood or heavy gauge fiber-impregnated plastic can also be used to effect the fence line of the present invention. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. A fence system comprising:

a first termination post assembly having a first fencing material connection member;

a second termination post assembly having a fixed journal having a longitudinal axis and a fencing material tensioning member for simultaneously tensioning a multiplicity of generally parallel spaced apart wire strands in a length of fencing material, said tensioning member having a cylindrical sleeve member having a rotational axis, said sleeve fully rotatable 360° about said fixed journal, said longitudinal axis and said rotational axis being aligned;

a second fencing material connection member attached to said sleeve member and extending generally parallel to said rotational axis, said second connection member accepting and retaining said multiplicity of spaced apart generally parallel wire strands to said sleeve member; and a locking member attached to said sleeve member to prevent rotation of said sleeve about said fixed journal, said length of fencing material extending between said first termination post assembly and said second termination post assembly, said fencing material having said multiplicity of generally parallel spaced apart wire strands.

2. The system of claim 1 wherein said fencing material further comprises a multiplicity of spaced apart high tensile wires jacketed by a fence webbing, said webbing extending within the space between said wires.

3. The system of claim 2 further comprising shim material between layers of said fence webbing at said first and second termination post assemblies.

4. The system of claim 1 wherein said first fencing material connection member is a second fencing material tensioning member.

5. The system of claim 1 wherein said fixed journal is a fence post.

6. The system of claim 1 wherein said fixed journal is a bracket attached to a fence post.

7. The system of claim 6 wherein said fence post is wooden.

8. The system of claim 1 further comprising:

an intermediate support post assembly spaced between said first and second termination post assemblies;

said intermediate support post slidably securing and supporting said fencing material.

9. The system of claim 1 further comprising:

a multiplicity of intermediate support post assemblies spaced apart from each other between said first and second termination post assemblies, said intermediate assemblies slidably securing and supporting said fencing material.

10. The system of claim 1 wherein said first termination post assembly is a first side of a pivotable gate and said second termination post assembly is a second side of said gate.

11. The system of claim 10 further comprising:

a first fence line termination post assembly having a third fencing material connection member;

a second fence line termination post assembly having a second fencing material tensioning member, said second tensioning member further comprising:

a generally rotatable second cylindrical sleeve member having a second rotatable axis;

a fourth fencing material connection member attached to said second sleeve member and extending generally parallel to said second rotational axis; and a second locking member to prevent rotation of said second sleeve.

12. A fence system comprising:

a first termination post assembly having a first fencing material connection member;

a length of fencing material extending between said first termination post assembly and a second termination post assembly, said fencing material having a multiplicity of generally parallel spaced apart wire strands, said strands connected by a fence webbing, said webbing extending within the space between said wire strands;

said second termination post assembly having a fixed journal having a longitudinal axis and a fencing material tensioning member for simultaneously tensioning said multiplicity of wire strands, said tensioning member further comprising;

a cylindrical sleeve having a rotational axis, said sleeve fully rotatable 360° about said fixed journal, said longitudinal axis and said rotational axis being aligned;

a second fencing material connection member attached along an outer face of said sleeve and extending generally parallel to said rotational axis, said second connection member accepting and retaining said multiplicity of wire strands and having a multiplicity of spaced apart generally parallel wire strand retaining grooves cooperating with said wire strands of said fencing material to retain said strands to said cylindrical sleeve; and a locking screw extending through said sleeve and engaging said fixed journal to prevent rotation of said sleeve about said fixed journal.

* * * * *